US008723407B2

(12) United States Patent
Hutchison et al.

(10) Patent No.: US 8,723,407 B2
(45) Date of Patent: May 13, 2014

(54) METHOD OF MAKING ZINC OXIDE NANOWIRES

(75) Inventors: James E. Hutchison, Eugene, OR (US); Daisuke Ito, Kanagawa (JP)

(73) Assignee: The State of Oregon Acting by and Through the State Board of Higher Education on Behalf of the University of Oregon, Eugene, OR (US)

( * ) Notice: Subject to any disclaimer, the term of this patent is extended or adjusted under 35 U.S.C. 154(b) by 188 days.

(21) Appl. No.: 12/370,499

(22) Filed: Feb. 12, 2009

(65) Prior Publication Data

US 2009/0267479 A1 Oct. 29, 2009

Related U.S. Application Data

(60) Provisional application No. 61/028,144, filed on Feb. 12, 2008.

(51) Int. Cl.
*H01J 19/06* (2006.01)
*H01K 1/04* (2006.01)

(52) U.S. Cl.
USPC ..... 313/346 R; 977/842; 977/939

(58) Field of Classification Search
USPC ..... 313/495–512; 445/24
See application file for complete search history.

(56) References Cited

U.S. PATENT DOCUMENTS

| | | | | |
|---|---|---|---|---|
| 2003/0168964 | A1* | 9/2003 | Chen | 313/495 |
| 2003/0173541 | A1* | 9/2003 | Peng et al. | 252/301.408 |
| 2004/0146560 | A1* | 7/2004 | Whiteford et al. | 424/484 |
| 2004/0233649 | A1* | 11/2004 | Honlein et al. | 361/760 |
| 2007/0247048 | A1* | 10/2007 | Zhang et al. | 313/311 |
| 2008/0299307 | A1* | 12/2008 | Ward et al. | 427/249.1 |

* cited by examiner

*Primary Examiner* — Anh Mai
*Assistant Examiner* — Zachary J Snyder
(74) *Attorney, Agent, or Firm* — Klarquist Sparkman, LLP

(57) ABSTRACT

Methods for selectively depositing nanostructures on a support layer include contacting the support layer with functionalized catalyst particles. The functionalized catalyst particles can form a self-assembled monolayer of catalyst particles on the support layer and the functionalized catalyst particles can be used to catalyze nanostructure growth. In one embodiment of the disclosed method, zinc oxide nanowires are grown on a patterned substrate using functionalized gold nanoparticles. Patterned arrays of self-assembled nanostructures and nanoscale devices using such nanostructure arrays are also described.

25 Claims, 8 Drawing Sheets

METHOD OF MAKING ZINC OXIDE NANOWIRES

CROSS REFERENCE TO RELATED APPLICATION

This application claims the benefit of the earlier filing date of U.S. provisional patent application No. 61/028,144, filed Feb. 12, 2008, which is incorporated herein by reference.

FIELD

The present application is directed to the field of nanostructures, for example nanowires and methods of nanowire growth.

BACKGROUND

Self-assembled nanostructures have a wide range of potential applications in the areas of optics and electronics. For example, arrays of self-assembled nanostructures can be used in applications such as nanoscale transistors, sensors, light emitting devices, and field emitting devices. These and other applications can benefit from nanostructure synthesis techniques that permit nanostructure alignment, allow for control of nanostructure size, and enable selective growth of nanostructures while reducing cost and facilitating large-scale fabrication.

Current state of the art is deficient in several respects. For example, methods using evaporated metal films as a catalyst for nanostructure growth typically lack control over the size and density of the grown nanostructures and can generate significant metal waste.

Thus, there is a need to develop new methods for nanostructure growth and nanostructure assembly.

SUMMARY

The present disclosure describes nanostructures, functionalized nanoparticles, and embodiments of a method of nanostructure synthesis using functionalized catalyst particles.

Disclosed herein are embodiments of a method for selectively depositing nanowires on a support layer. In one embodiment, a monolayer of catalyst particles is deposited on the support layer and nanostructure growth is catalyzed by the catalyst particles. In one aspect of the embodiment, the catalyst particles are functionalized to selectively bond to the support layer. In some examples, the support layer is a patterned support layer. In some embodiments, the catalyst particles are nanoparticles modified with a functionalized thiol ligand shell. In some examples, the catalyst particles are functionalized with a phosphonic acid.

Patterned arrays of self-assembled nanostructures are also disclosed herein. In some examples, nanostructures are attached to catalyst particles via linker molecules. In some examples, the linker molecule includes a thiol group and a phosphonic acid group. In some examples, the nanostructures are zinc oxide nanowires and the catalyst particles are gold nanoparticles.

Nanoscale devices including nanostructure arrays are also described. Disclosed nanoscale devices can include patterned arrays of self-assembled nanowires. In some examples, the nanowires are chemically bonded to nanoparticles via ligands.

The foregoing and other objects, features, and advantages will become more apparent from the following detailed description, which proceeds with reference to the accompanying figures.

DETAILED DESCRIPTION

Figure 1:
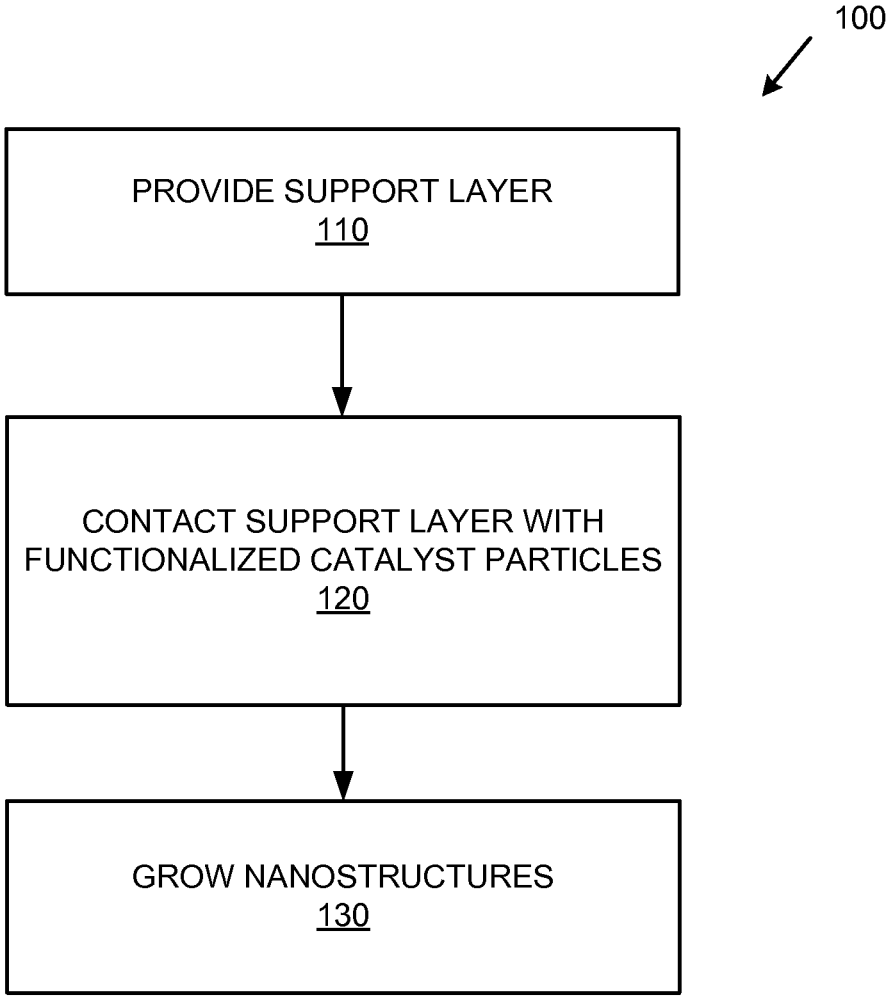
FIG. 1 is a flowchart of an exemplary method for growing nanostructures using functionalized catalyst particles.

As used in this application and in the claims, the singular forms "a," "an," and "the" include the plural forms unless the context clearly dictates otherwise. Additionally, the term "includes" means "comprises." Further, the term "coupled" means electrically, electromagnetically, or optically coupled or linked and does not exclude the presence of intermediate elements between the coupled items.

The described systems, apparatus, and methods described herein should not be construed as limiting in any way. Instead, the present disclosure is directed toward all novel and non-obvious features and aspects of the various disclosed embodiments, alone and in various combinations and sub-combinations with one another. The disclosed systems, methods, and apparatus are not limited to any specific aspect or feature or combinations thereof, nor do the disclosed systems, methods, and apparatus require that any one or more specific advantages be present or problems be solved.

Although the operations of some of the disclosed methods are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the attached figures may not show the various ways in which the disclosed systems, methods, and apparatus can be used in conjunction with other systems, methods, and apparatus. Additionally, the description sometimes uses terms like "produce" and "provide" to describe the disclosed methods. These terms are high-level abstractions of the actual operations that are performed. The actual operations that correspond to these terms will vary depending on the particular implementation and are readily discernible by one of ordinary skill in the art.

Theories of operation, scientific principles, or other theoretical descriptions presented herein in reference to the apparatus or methods of this disclosure have been provided for the purposes of better understanding and are not intended to be limiting in scope. The apparatus and methods in the appended claims are not limited to those apparatus and methods which function according to scientific principles or theoretical descriptions presented herein.

In general, a nanostructure is an object or structure having one or more dimensions on the nanoscale such having a length scale in a nanometer or micrometer range. For example, a nanostructure can have one or more dimensions which are between about 0.1 nm and about 10 μm. As used herein, a "nanowire" is a nanostructure having at least two dimensions that are on the nanoscale. For example, a two-dimensional cross-section of a nanowire can be on the nanoscale and much smaller than a third dimension or length of the nanowire. Nanowires can have a range of lengths and effective diameters and nanowires can have cross-sections of various shapes. For example, nanowires can have circular, square, trapezoidal, or other shaped cross-sections which can be characterized by an effective diameter. In some embodiments, a nanowire can have an average length between about 40 nm and about 20 μm, such as between about 100 nm and about 2 μm. In some examples, nanowires can have lengths greater than 20 μm. A nanowire can have an average effective diameter between about 10 nm and about 400 nm, such as between about 20 nm and about 200 nm. A nanowire has an aspect ratio (i.e., a ratio of the structure length to the structure width) that is greater than 1 and typically greater than about 5, such as between about 5 and about 100, or greater than about 50, such as from about 50 to 200. In some embodiments, nanowires have an aspect ratio larger than 200, such as between about 200 and 2000.

As used herein, a "nanoparticle" is a particle having a diameter of less than about one micron. In some embodiments, nanoparticles can have a diameter of from about 0.5 nm to about 500 nm, such as from about 0.7 nm to about 5 nm or from about 5 nm to about 200 nm.

I. Nanostructure Materials

Disclosed nanostructures and embodiments of the disclosed method for nanostructure growth are not limited to nanostructures of a particular material, though particular materials are described herein. Exemplary nanostructure materials include nitrides, carbon, and oxides such as zinc oxide or other metallic oxides. In general, disclosed nanostructures can be generated based on a catalyst growth mechanism and therefore include materials that can be catalyzed for nanostructure growth.

Any catalytic methods for nanostructures growth can be used with or combined with disclosed embodiments. Exemplary catalytic methods of nanostructure growth include, but are not limited to, vapor-liquid-solid (VLS) methods, vapor-solid (VS) methods, and chemical vapor deposition (CVD) methods. Therefore, in some embodiments of the disclosed method, nanostructures can be grown rapidly and without the need for vacuum systems.

In general, once a nanostructure material is chosen, an appropriate catalyst material and an appropriate support layer composition can be determined, and the determination can be based on a catalytic growth method, on the nanostructure material chosen, or both. Disclosed embodiments can include any possible nanostructure material/catalyst combinations. For example, catalyst particles can include Group VI metals, Group VII metals, gold, copper, silver, and combinations thereof. In some embodiments, catalyst particles are nanoparticles.

In general, a support layer is a layer of material that provides a surface for nanostructure growth. A support layer can include a substrate, the support layer can be a substrate, or the support layer can be a layer of material deposited onto a substrate. For example, the support layer can be in contact with the substrate or with other materials that have been deposited or otherwise formed or situated on a prepared substrate. A substrate can include silicon, silicon dioxide, titanium, sapphire, and combinations thereof. For example, the substrate can be a silicon substrate having a layer of silicon dioxide on a surface of the substrate. The support layer can include a nanostructure precursor. In some examples, the support layer includes an oxophilic metal or an oxide such as hafnium-modified silicon dioxide, indium tin oxide, or zinc oxide. For example, the support layer can be a zinc oxide film deposited onto a substrate. The support layer, the substrate, or both can be patterned such as by using lithography techniques.

Exemplary nanostructure material/catalyst/support layer combinations include carbon nanotubes grown from nickel catalyst particles on a titanium or silicon substrate using plasma enhanced CVD (PE-CVD), and zinc oxide nanowires grown from gold catalyst nanoparticles on a zinc oxide support layer using VLS growth mechanism.

Typically, once a suitable catalyst material is selected, catalyst particles can be synthesized and subsequently functionalized to enable the catalyst particles to selectively bond with a surface. For example, catalyst particles can include functional groups that enable the particles to selectively couple to a support layer. Disclosed nanostructures and embodiments of the disclosed method for nanostructure growth are not limited to catalyst particles with particular functionalities. In general, any functional group/support layer, or ligand/support layer, interactions can be used with disclosed nanostructures and in embodiments of the disclosed method.

In general, a functionalized catalyst particle includes a particle and a linker molecule. Linker molecules can include one or more ligands and such ligands can be for bonding to catalyst particles, for bonding to a support layer, or both. In general, particles can be functionalized by directly forming such particles having the appropriate ligands attached thereto. Nanoparticles can be functionalized by first forming ligand-stabilized nanoparticles, which act as precursors for ligand exchange reactions. Ligand-stabilized nanoparticles generally include a nanoparticle having one or more exchangeable ligands.

Ligand exchange reactions form functionalized nanoparticles by replacing stabilizing ligands with ligands that are more useful for coupling nanoparticles to a support layer. To perform ligand-exchange reactions, typically, a reaction mixture is formed comprising the nanoparticle having exchangeable ligands attached thereto and the ligands to be attached to the nanoparticle, such as thiols. A precipitate generally forms upon solvent removal, and this precipitate is then isolated by conventional techniques.

Ligands suitable for forming nanoparticles may be selected, without limitation, from the group consisting of sulfur-bearing compounds, such as thiols, thioethers, thioesters, disulfides, and sulfur-containing heterocycles; selenium bearing molecules, such as selenides; nitrogen-bearing compounds, such as 1°, 2° and perhaps 3° amines, aminooxides, pyridines, nitriles, and hydroxamic acids; phosphorus-bearing compounds, such as phosphines; and oxygen-bearing compounds, such as carboxylates, hydroxyl-bearing compounds, such as alcohols, and polyols; and mixtures thereof. Particularly effective ligands for metal nanoparticles may be selected from compounds bearing elements selected from the chalcogens. Of the chalcogens, sulfur is a particularly suitable ligand, and molecules comprising sulfhydryl moieties are particularly useful ligands for stabilizing metal nanoparticles. Additional guidance concerning the selection of ligands can be obtained from Michael Natan et al's Preparation and Characterization of Au Colloid Monolayers, *Anal. Chem.* 1995, 67, 735-743, which is incorporated herein by reference.

Sulfur-containing molecules (e.g., thiols, sulfides, thioesters, disulfides, sulfur-containing heterocycles, and mixtures thereof) comprise a particularly useful class of ligands. Thiols, for example, are a suitable type of sulfur-containing ligand for several reasons. Thiols have an affinity for gold, and gold, including gold particles and gold nanoparticles, may be used as a catalyst in nanostructure growth. Moreover, thiols are good ligands for stabilizing gold nanoparticles, and many sulfhydryl-based ligands are commercially available. The thiols form ligand-stabilized metal nanoparticles having a formula $M_x(SR)_n$ wherein M is a metal, R is an aliphatic group, typically an optionally substituted chain (such as an alkyl chain) or aromatic group, x is a number of metal atoms that provide metal nanoparticles, and n is the number of thiol ligands attached to the ligand-stabilized metal nanoparticles.

A linker molecule is adapted to bind to a substrate, a support layer, and/or an oxophilic metal deposited thereon, thereby linking the nanoparticle to the support layer. Functionalized nanoparticles include a wide variety of nanoparticles of the general formulas CORE-L-$(S—X)_n$, wherein L is a linker and X is a functional group or chemical moiety that serves to couple the nanoparticle to a the support layer, and n is at least one.

For example, X may include without limitation phosphonic acid groups, carboxylic acid groups, sulfonic acid groups, peptide groups, amine groups, and ammonium groups. Other functional groups that may be part of X include aldehyde groups and amide groups. Functionalized nanoparticles can be prepared from phosphine-stabilized nanoparticles of the formula CORE-$(PR_3)_n$, where the R groups are independently selected from the group consisting of aromatic, such as phenyl and aliphatic groups, such as alkyl, typically such alkyl groups have 20 or fewer carbons, for example, cyclohexyl, t-butyl or octyl, and n is at least one.

Linker molecules can be bifunctional. Such linker molecules have one functional group adapted to coordinate such as covalently or non-covalently bond with a nanoparticle and a second functional group adapted to coordinate to a support layer. The first and second functional groups may be the same or different. One example of such bifunctional linker molecules has the formula

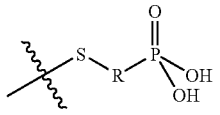

wherein R comprises an aliphatic group. R can include a lower alkyl group, and/or an aryl group, such as a phenyl or biphenyl moiety or R can represent an alkylene group, optionally interrupted with one or more heteroatoms, such as oxygen or nitrogen. Examples of such alkylene groups interrupted with oxygen include polyethylene glycol (PEG) and/or polypropylene glycol (PPG) chains. As used herein, PEG and PPG refer to oligomeric groups having as few as two glycol subunits. Exemplary R groups include, without limitation, $—CH_2CH_2—$, $—CH_2CH_2OCH_2CH_2—$ and $—CH_2CH_2OCH_2CH_2OCH_2CH_2—$.

In some embodiments, functionalized catalyst particles are catalyst particles modified with a terminally functionalized ligand shell such as a thiol ligand shell. Because terminal functionality of a ligand shell can dictate the interactions that occur between the catalyst particles and the substrate or support layer, a functional group can be chosen based on properties of a substrate and/or a support layer. In one embodiment, catalyst particles are functionalized with a phosphonic acid such as alkylphosphonic acid or 2-mercaptoethylphosphonic acid (2-MEPA). For example, a phosphonic acid functionalized gold nanoparticle can have a thiol group attached to the gold nanoparticle and a phosphonic acid group attached to the thiol group, wherein the phosphonic acid group selectively binds to a support layer. In this example, the functionalized catalyst particle includes a linker molecule and a gold nanoparticle, wherein the linker molecule includes a thiol group and a phosphonic acid group.

Functionalized gold nanoparticles can be produced using methods described by Weare, W. W.; Reed, S. M.; Warner, M. G.; Hutchison, J. E., *J. Am. Chem. Soc.* 2000, 122, 12890-12891, which is incorporated herein by reference, and Hutchison, J. E.; Foster, E. W.; Warner, M. G.; Reed, S. M.; Weare, W. W., in *Inorg. Syn.*; Buhro, W., Yu, H., Eds., 2004; Vol. 34, pp 228, which is incorporated herein by reference.

Methods disclosed herein can be optionally combined with methods disclosed in PCT Patent Application No. PCT/US2006/018716, entitled METHOD FOR FUNCTIONALIZING SURFACES, filed May 12, 2006, in the names of James E. Hutchison, Christina E. Imnan, Gregory J. Kearns and Evan Foster, which is incorporated herein by reference in its entirety. Also incorporated herein by reference is PCT Patent Application No. PCT/US2006/019861, entitled NANOPARTICLES AND METHOD TO CONTROL NANOPARTICLE SPACING, and filed May 22, 2006.

II. Methods for Nanostructure Assembly

FIG. 1 is a flowchart of an exemplary method 100 for nanostructure synthesis using functionalized catalyst particles. For example, the method 100 can be used to grow nanostructures and nanostructure arrays from selectively deposited catalyst particles.

With respect to FIG. 1, a support layer is provided at 110. For example, providing a support layer can include depositing a layer of support material onto a substrate.

At 120, the support layer is contacted with functionalized catalyst particles. For example, the support layer can be contacted with a solution containing functionalized catalyst particles. The functionalized catalyst particles include catalyst particles that have been functionalized to selectively chemically anchor to the support layer. For example, the functionalized particles can be functionalized to bond with the support layer and to generally not bond with the substrate.

The functionalized catalyst particles that bond with the support layer can be referred to as selectively deposited particles. The selectively deposited particles can be considered to be self-assembled because the particles assemble or couple to the support layer based on functional groups coupled to the particles. The selectively deposited particles can form a monolayer of catalyst particles on the support layer. The catalyst particles include materials that can catalyze nanostructure growth on the support layer.

At 130, nanostructures are grown. The growth of the nanostructures is assisted by the catalyst particles, and the nanostructures can be grown using any catalytic method of nanostructure growth. Nanostructure size, such as nanostructure height and diameter, can depend on parameters of the chosen catalytic method of growth and on the size of the functionalized catalyst particles. In some examples, the size and density of nanostructures can be tuned such as by controlling catalyst particle diameter, linker molecule size (e.g., ligand shell length), growth temperature, and growth time.

Figure 2:
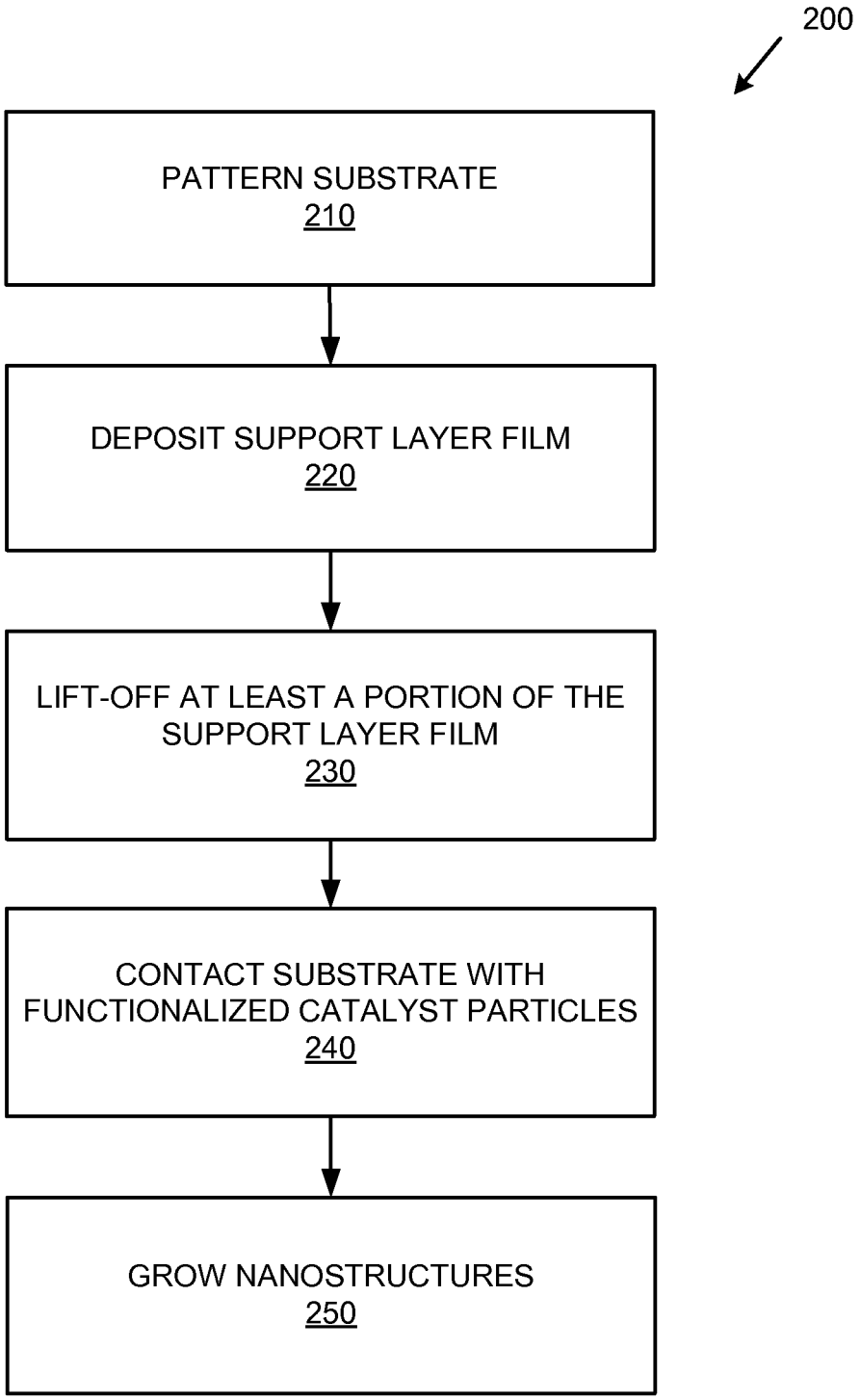
FIG. 2 is a flowchart of an exemplary method for growing nanostructures wherein nanostructure growth is based on catalyst particles that have been selectively deposited on a user defined template.

FIG. 2 is a flowchart of an exemplary method 200 of nanostructure synthesis wherein nanostructures and nanostructure arrays are grown according to a user defined template. For example, the method enables patterned growth of nanostructures and nanostructure arrays through selectively depositing functionalized catalyst particles on a patterned support layer.

At 210, a substrate is patterned. The substrate can be patterned using lithographic techniques. For example, a layer of resist can be deposited onto the substrate and patterned using photolithography techniques.

At 220, a support layer film is deposited onto the patterned substrate. The support layer can be deposited using standard deposition techniques. For example, the patterned substrate can be spin-coated with the support layer material.

At 230, at least a portion of the support layer film is lifted-off from the patterned substrate. For example, the patterned substrate, including the deposited support layer film, can be contacted with a solvent capable of dissolving resist on the substrate. Portions of the support layer film deposited onto the resist are released from the substrate as the resist dissolves, while portions of the support layer film in contact with the substrate are generally not removed by the solvent. The resulting substrate can include portions of exposed substrate and remainder portions of the support layer that were not lifted-off.

At 240, the substrate including remainder portions of the support layer film is contacted with functionalized catalyst particles. The catalyst particles are functionalized to selectively anchor to the remainder portions of the support layer and not to the substrate.

At 250, nanostructures are grown on the remainder portions of the support layer, wherein the growth is catalyzed by the selectively anchored catalyst particles. In this manner, the remainder portions of the support layer provide a user defined template for nanostructure growth.

Using method 200, nanostructures can be selectively placed or grown on a surface without patterning a catalyst film.

Figure 3:
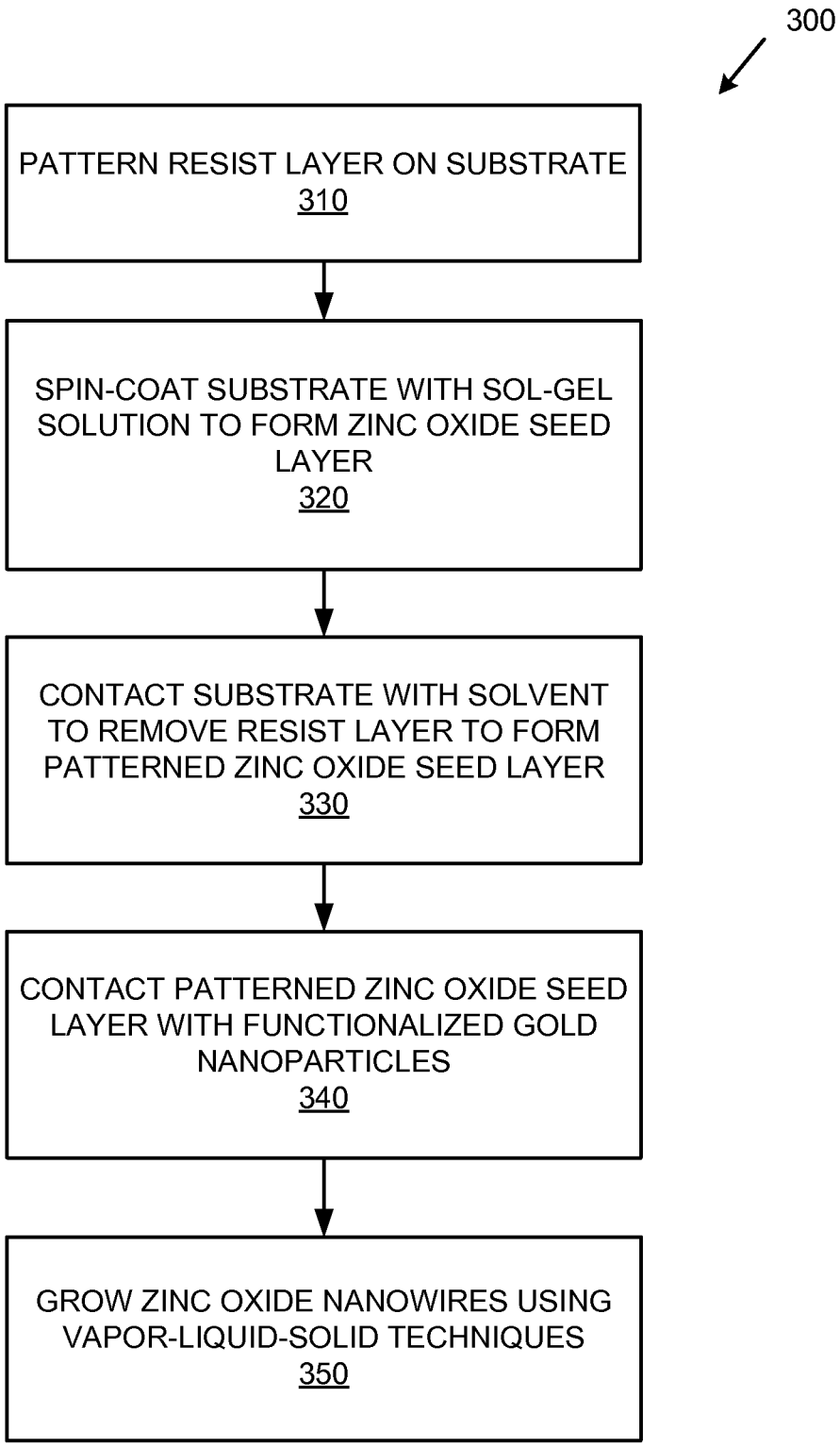
FIG. 3 is a flowchart of an exemplary method for growing zinc oxide nanowires using functionalized gold nanoparticles.

FIG. 3 is a flow-chart of an exemplary method 300 wherein zinc oxide nanowires are selectively deposited and assembled. Zinc oxide can be a particularly attractive material for optical devices that operate at room temperature because zinc oxide has a wide band gap and a large exciton binding energy. Therefore, self-assembled zinc oxide nanowires, such as those produced according to method 300, can be used for applications such as nanoscale transistors, nanogenerators, sensors, light emitting devices, and field emitting devices.

With regard to FIG. 3, at 310, a resist layer is deposited on a surface of a substrate and the resist layer is patterned. The resist layer can be deposited and patterned using standard lithography techniques. The substrate can be a sapphire substrate or a silicon substrate including a layer of silicon dioxide. At 320, a zinc oxide seed layer is deposited on the patterned surface by spin-coating the surface with a zinc oxide sol-gel solution.

At 330, the substrate is contacted with a solvent to dissolve the patterned resist layer. Portions of the zinc oxide film that were deposited onto the resist layer are lifted off during contact with the solvent, thereby forming a patterned zinc oxide seed layer on the substrate surface. The patterned zinc oxide seed layer can be annealed to form a patterned c-oriented zinc oxide seed layer. Seed layers having other orientations can also be used. At 340, the patterned zinc oxide seed layer is contacted with functionalized gold nanoparticles. The gold nanoparticles are functionalized such that they selectively anchor to the zinc oxide seed layer and not to the substrate surface. For example, the gold nanoparticles can be functionalized with a phosphonic acid. At 350, zinc oxide nanowires are grown using vapor-liquid-solid techniques, wherein the gold nanoparticles catalyze the nanowire growth.

Figure 4:
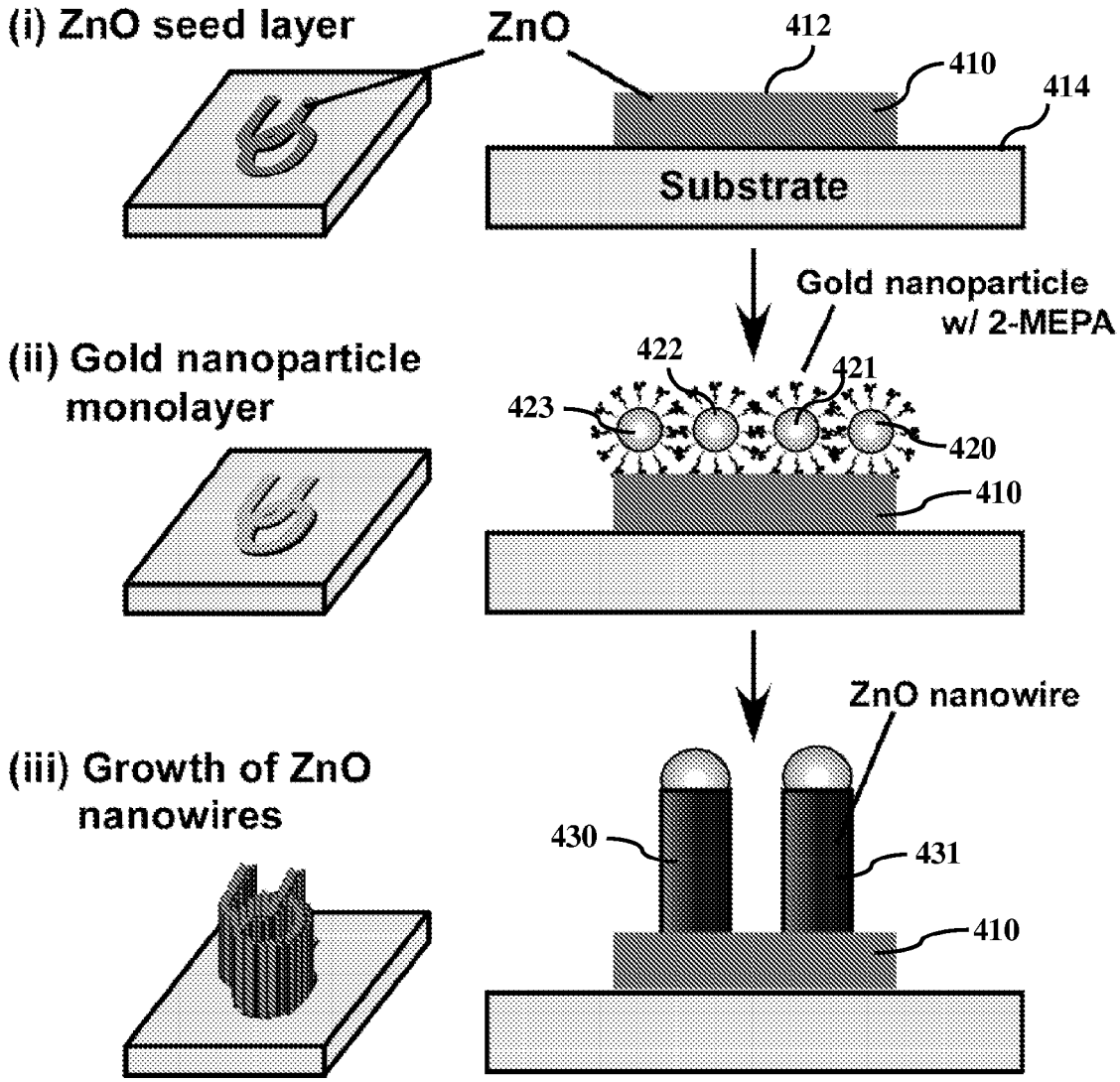
FIG. 4 includes elevational and cross-sectional views of a substrate during three stages of nanostructure growth.

FIGS. 4(*i*)-4(*iii*) include elevational and cross-sectional views that illustrate substrate processing during three stages of zinc oxide nanowire growth according to embodiments of the method described herein. FIG. 4(*i*) is an illustration of a patterned zinc oxide seed layer 410 which functions as a template for zinc oxide nanowire growth. FIG. 4(*i*) can be an illustration of a substrate after 330 in method 300 has been performed, for example.

FIG. 4(*ii*) illustrates chemically anchored gold nanoparticles 420-423 forming a selectively deposited monolayer on a surface 412 of the patterned zinc oxide seed layer 410. The gold nanoparticles 420-423 are functionalized with 2-MEPA and selectively anchor to the patterned zinc oxide seed layer 410 and not to a substrate surface 414. FIG. 4(*ii*) can be an illustration of a substrate after 340 in method 300 has been performed, for example. FIG. 4(*iii*) is an illustration of zinc oxide nanowires 430, 431 grown from the seed layer surface 412, wherein the nanowires 430, 431 grow predominantly at sites where gold nanoparticles have anchored to the seed layer. The gold nanoparticles form "caps" on ends of the grown nanowires. FIG. 4(*iii*) can be an illustration of a substrate after 350 in method 300 has been performed, for example.

Figure 5:
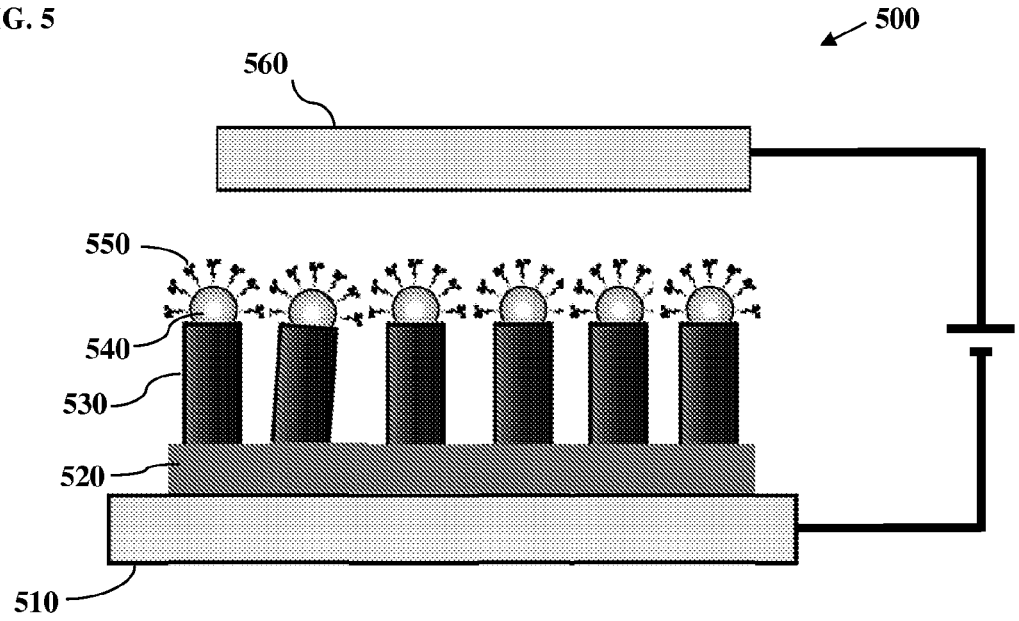
FIG. 5 is a schematic of a field emission device including nanowires.

FIG. 5 is a schematic of a field emission device 500 that includes a plurality of nanowires 530. The nanowires 530 can be grown according to embodiments described herein. The nanowires 530 can be grown on a seed layer 520 and the seed layer 520 can be patterned. Functionalized catalyst nanoparticles 540 can form caps on ends of the nanowires 530 and linker molecules 550 can be coupled to the nanoparticles 540. The nanowires 530 are electrically coupled to a substrate 510 which can be configured to function as a cathode. An electrode 560 can be configured to act as an anode and positioned proximate to the nanowires. The application of a potential difference across the device can allow electrons to tunnel from the cathode to the anode such that device 500 acts as a field emission device. Such a field emission device can be used in applications for display devices such as a flat panel display.

In some examples described herein, the amount of catalyst material used during nanostructure synthesis is greatly reduced from conventional methods. The examples demonstrate that less catalyst waste can be generated and, therefore, nanostructure device production costs can be potentially reduced. For example, when only sufficient catalyst material to cover a seed layer such as a patterned seed layer is used, the amount of generated catalyst waste can be much smaller than methods such as vapor deposition in which a catalyst film is deposited over an area larger than the seed layer.

III. Example

General methods

In this example, zinc oxide nanowires were grown using self-assembled arrays of gold nanoparticles. First, the gold nanoparticles were synthesized and modified with a terminally functionalized thiol ligand shell. Then, a patterned zinc oxide seed layer was prepared on a substrate and the substrate was immersed in an aqueous solution of gold nanoparticles. The gold nanoparticles selectively deposited onto the patterned zinc oxide seed layer and zinc oxide nanowires were grown by a vapor-liquid-solid method.

Preparation of Functionalized Catalyst Nanoparticles

To synthesize the gold nanoparticles, hydrogen tetrachloroaurate trihydrate ($HAuCl_4.3H_2O$, 1.00 g, 2.54 mmol) in water was reacted with triphenylphosphine ($PPh_3$, 2.33 g, 8.88 mmol) in toluene in the presence of the phase-transfer catalyst tetraoctylammonium bromide (TOAB, 1.40 g, 2.56 mmol). Reduction with $NaBH_4$ (1.99 g, 52.6 mmol) yielded $PPh_3$-stabilized gold nanoparticles with an average diameter of about 1.5 nm (1.5 nm±0.4 nm).

Ligand exchange was performed by dissolving the $PPh_3$-stabilized gold nanoparticles in dichloromethane and mixing the dissolved nanoparticles with one mass equivalent of 2-mercaptoethylphosphonic acid (2-MEPA) dissolved in water. The ligand exchange solution was stirred for 48 hours. When an organic layer in the ligand exchange solution was nearly colorless, an aqueous layer was separated, washed with dichloromethane, and purified by diafiltration using a 10 kD diafiltration capsule (from Pall Life Sciences) and approximately 50 volume equivalents of deionized water. The resulting nanoparticle solution included gold nanoparticles functionalized with 2-MEPA. The functionalized gold nanoparticles were considered pure when no free ligand was evident after analysis using proton nuclear magnetic resonance ($^1H$ NMR) spectroscopy. The functionalized gold nanoparticles included thiol groups attached to gold nanoparticles and to phosphonic acid groups. The functionalized gold nanoparticle solution was then diluted with deionized water to achieve a desired concentration.

Figure 6:
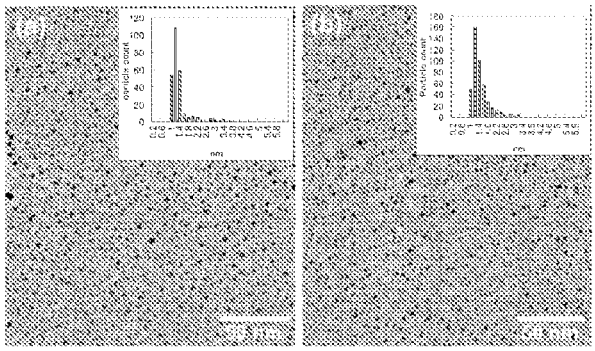
FIG. 6 is a (a) TEM image of gold nanoparticles with $PPh_3$ ligand shells and a (b) TEM image of gold nanoparticles with 2-MEPA ligand shells.

FIG. 6 shows transmission electron microscope (TEM) images of gold nanoparticles with $PPh_3$ ligand shells (FIG. 6(*a*)) and with 2-MEPA ligand shells following ligand exchange (FIG. 6(*b*)). The TEM images were acquired using a Philips CM12 Transmission Electron Microscope operating at an accelerating voltage of 120 kV. These TEM images indicate that the size distribution and dispersity of gold nanoparticles was similar before and after ligand exchange. The gold nanoparticles exhibited average diameters of 1.3 nm and 1.4 nm in FIGS. 6(*a*)-6(*b*), respectively. Diameter distributions of the nanoparticles are also shown in FIGS. 6(*a*)-6(*b*).

Preparation of Zinc Oxide Seed Film

A zinc oxide sol-gel solution was prepared by first dissolving zinc acetate dihydrate ($(CH_3COO)_2Zn.2H_2O$) (5 g, 22 mmol) in 2.5 mL ethylene glycol. This mixture was then heated at 150° C. for 15 minutes in a condensation system. After the solution cooled to room temperature and became transparent, 8 mL 1-propanol and 0.2 mL glycerol were added, followed by 5 mL triethylamine and 0.1 mL water. The resulting solution was stirred at 35° C. for 30 hours. This sol-gel precursor solution was then diluted with isopropanol to a concentration of 50 mM.

A silicon substrate (a 1 $cm^2$ wafer) possessing a 3-μm layer of $SiO_2$ was patterned using photolithographic patterning techniques. A zinc oxide seed film was then deposited onto the patterned substrate by spin-coating the wafer with the sol-gel precursor solution at 3000 rpm for 60 seconds. Lift-off of photoresist was performed using standard techniques to create a patterned seed layer on the wafer. The patterned wafers were pre-baked at 150° C. for 10 minutes to drive off any remaining solvent and then annealed at 350° C. for 30 minutes. The resulting films were patterned c-oriented zinc oxide seed layers. Patterned zinc oxide surfaces were treated with UV-ozone for 5 minutes and rinsed with deionized water to remove adventitious carbon contamination.

Contacting Prepared Substrate with Nanoparticle Solution

Wafers with patterned c-oriented zinc oxide seed layers were then immersed into a 0.25 mg/mL solution of functionalized gold nanoparticles for 10 seconds. The samples were then rinsed with copious amounts of deionized water to remove physisorbed or unbound particles and then dried under a stream of nitrogen prior to further modification or analysis. Because zinc oxide exhibits spontaneous polarization in the wurtzite structure and silicon and $SiO_2$ have no surface charge, the functionalized gold nanoparticles assembled onto the zinc oxide surface selectively. During nanoparticle self-assembly, it is currently understood that a thiol group attaches to a phosphonic acid group and to a gold nanoparticle, and the phosphonic acid group allows the nanoparticle to anchor to the zinc oxide film and not to exposed silicon or $SiO_2$. The resulting wafers, having selectively deposited nanoparticles, are sometimes referred to as nanoparticle modified wafers or as having a nanoparticle modified surface.

Less than 50 μL of the 0.25 mg/mL gold nanoparticle solution, or less than 12.5 μg of gold, was used in this example. Typically, 0.2 g of gold is used by methods employing an evaporation system. Therefore, the mass of gold consumed in this example was at least 16,000 times less than the mass of gold typically consumed in an evaporation system for deposition of patterned gold films.

Figure 7:
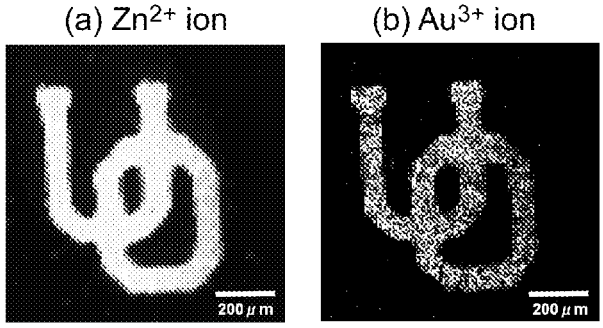
FIG. 7 includes positive ion mapping images using time-of-flight secondary ion mass spectrometry (a) for $Zn^{2+}$ ions and (b) for $Au^{3+}$ ions.

FIGS. 7(*a*)-7(*b*) are positive ion mapping images using time-of-flight secondary ion mass spectrometry (TOF-SIMS) of $Zn^{2+}$ and $Au^{3+}$ ions, respectively. The TOF-SIMS images were acquired with an ION-TOF Model IV Spectrometer using a bismuth liquid metal ion gun as the primary ion beam, operated at an accelerating voltage of 5 kV. These images demonstrate that gold nanoparticles were indeed selectively bonded or anchored onto the patterned zinc oxide seed layer. The zinc oxide surface was covered by a nanoparticle layer within 10 seconds, and no gold particles were observed on the bare $SiO_2$ substrate. The 2-MEPA ligand was, therefore, the anchoring agent between the gold nanoparticles and the zinc oxide surface.

Table 1 shows a TOF-SIMS quantitative analysis of ion yields for a series of immersion times of the substrate in a gold nanoparticle solution. The TOF-SIMS quantitative analysis provides the film composition or ion yield as a function of the immersion time. In this analysis, the peak intensities for ionic fragments of interest were divided by total ion intensity in each measurement to compare the relative compositions among samples. Peaks for $Zn^{2+}$ and $Au^{3+}$ positive ions and $PO^{3-}$ and $S^{2-}$ negative ions were observed even if the immersion time was only 1 second. Table 1 also demonstrates that the ratio of gold to zinc was constant and independent of immersion time, indicating that the reaction time could have been less than one second.

TABLE 1

| Immersion time | $Zn^{2+}$ | $Au^{3+}$ | $PO_3^-$ | $S^{2-}$ |
|---|---|---|---|---|
| 1 seconds | 480.6 | 22.8 | 2171.9 | 224.9 |
| 3 seconds | 461.0 | 21.3 | 2115.5 | 200.4 |
| 10 seconds | 455.6 | 21.1 | 2118.2 | 233.8 |
| 30 seconds | 450.7 | 20.8 | 1943.9 | 266.3 |

Nanostructure Growth

Zinc oxide nanowires were grown by the vapor-liquid-solid (VLS) method on the patterned and gold nanoparticle modified wafers. A mixture of zinc oxide and carbon powder was placed in a small quartz tube as a zinc oxide source, and wafers with patterned zinc oxide seed layers and selectively deposited gold nanoparticles were placed downstream from the source. The wafer temperature was controlled at 600° C. The source temperature was raised to 900° C. and held for 20 minutes in a $N_2$ gas flow (2.5 SCFH). Then, the furnace was shut down and cooled to room temperature while maintaining the nitrogen flow.

Figure 8:
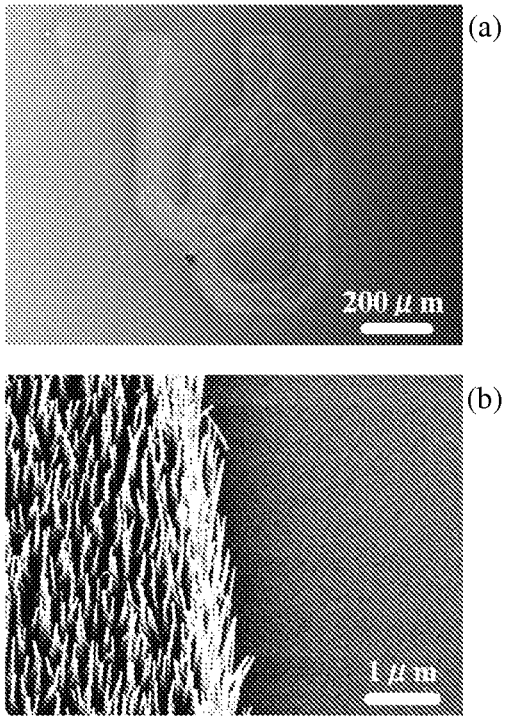
FIG. 8 includes low and high magnification SEM images of vapor-liquid-solid deposited zinc oxide nanowires.

FIGS. 8(*a*)-8(*b*) are SEM images of VLS-deposited zinc oxide nanowires, grown as described in the example. FIG. 8(*a*) is a low magnification SEM image and FIG. 8 (*b*) is a high magnification image. The SEM images were taken at a 30° tilt angle and were acquired with a Zeiss Ultra Scanning Electron Microscope operating at an accelerating voltage of 5 kV.

The images in FIG. 8 demonstrate that regions of nanowire growth correlate with gold patterns observed by TOF-SIMS ion mapping shown in FIGS. 7(*a*) and 7(*b*). Thus, the nanoparticle-modified pattered zinc oxide seed layer served as a selective template for the nanowire growth. FIG. 8 also demonstrates that the zinc oxide nanowires grew substantially vertically relative to the surface of the seed layer.

In the example, nanowires with an average diameter of about 40 nm or with an average diameter of about 30 nm were grown, the size distribution of the diameter being less than about 10 nm. In this example, the average height of the zinc oxide nanowires was varied from about 100 nm to a few micrometers by changing the growth time. For example, nanowires with an average height about 1 μm and with an average height of about 600 nm were grown.

IV. Example

In this example, zinc oxide nanowires grown according to Example III are compared to zinc oxide nanostructures grown by the VLS method on a bare $SiO_2$ substrate, on an unmodified zinc oxide seed layer, and on a modified zinc oxide seed layer on a c-sapphire substrate. The bare $SiO_2$ substrate is immersed in a gold nanoparticle solution during preparation. The resulting nanostructures are compared in the images of FIG. 9. The images in FIG. 9 demonstrate the effect of using catalyst nanoparticles through comparison of zinc oxide nanostructures grown with and without surface modification by nanoparticles.

Figure 9:
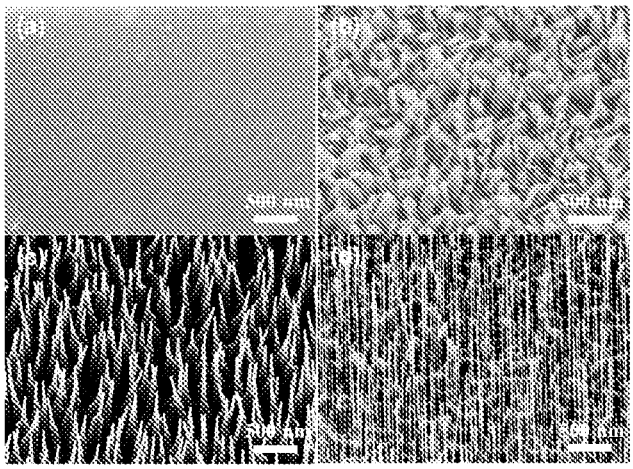
FIG. 9 includes SEM images of vapor-liquid-solid deposited zinc oxide (a) on a $SiO_2$ substrate, (b) on an unmodified zinc oxide seed layer, (c) on a gold nanoparticle-modified zinc oxide seed layer on $SiO_2$, and (d) on a gold nanoparticle-modified zinc oxide seed layer on a c-sapphire substrate.

In FIG. 9, image (a) is of VLS-grown zinc oxide on a bare $SiO_2$ substrate, image (b) is of VLS-grown zinc oxide on an unmodified zinc oxide seed layer, image (c) is of VLS-grown zinc oxide on a gold nanoparticle-modified zinc oxide seed layer on a $SiO_2$ substrate, and image (d) is of VLS-grown zinc oxide on a nanoparticle-modified zinc oxide seed layer on a c-sapphire substrate. The SEM images were acquired with a Zeiss Ultra Scanning Electron Microscope operating at an accelerating voltage of 5 kV.

FIG. 9(*a*) shows that no structures were produced when zinc oxide was deposited by VLS method onto a bare $SiO_2$ substrate without a zinc oxide seed layer. FIG. 9(*b*) shows VLS-deposited zinc oxide nanostructures on a zinc oxide seed layer without gold nanoparticle modification. The hexagonal columnar structure of the zinc oxide nanostructures is apparent in this image. FIG. 9(*c*) shows nanowire arrays grown on a nanoparticle-modified zinc oxide seed layer. This image indicates that the self-assembled gold nanoparticle array worked as a catalyst for the growth of zinc oxide nanowires. The nanowires shown in FIG. 9(*c*) are tilted slightly relative to the surface normal and are not uniformly parallel. This can be an effect of a non-epitaxial underlying substrate.

FIG. 9(*d*) shows zinc oxide nanowires grown by VLS on a c-sapphire substrate with a nanoparticle-modified zinc oxide seed layer. Relative to the nanowires in FIG. 9(*c*), the nanowires shown in FIG. 9(*d*) tended to be more uniformly parallel and to be aligned nearly perpendicularly to the underlying epitaxial substrate.

V. Example

Figure 10:
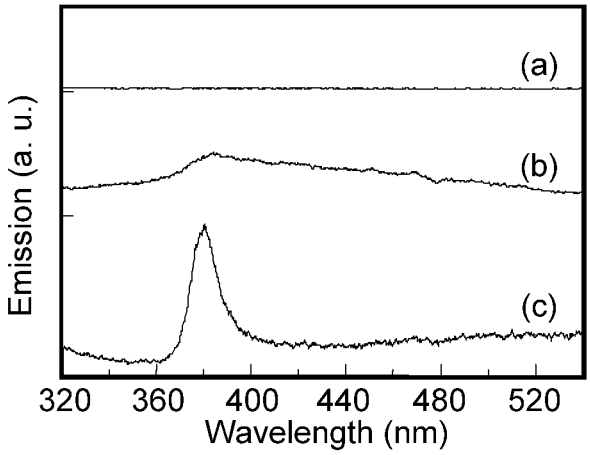
FIG. 10 is a plot of photoluminescence spectra for vapor-liquid-solid deposited zinc oxide (a) on a $SiO_2$ substrate, (b) on an unmodified zinc oxide seed layer, and (c) on a gold nanoparticle-modified zinc oxide seed layer.

In this example, photoluminescence (PL) properties of zinc oxide nanowires grown according to Example III are compared to PL properties of zinc oxide nanostructures grown directly on a $SiO_2$ substrate and of zinc oxide nanostructures grown on an unmodified zinc oxide seed layer. PL measurements were performed at room temperature using a xenon lamp as the light source, with an excitation wavelength of 300 nm. FIG. 10 shows PL spectra of VLS-grown zinc oxide (a) directly on a $SiO_2$ substrate, (b) on a zinc oxide seed layer that has not been modified with gold nanoparticles, and (c) on a gold nanoparticle-modified zinc oxide seed layer. The spectra (a)-(c) are from samples identical to those in FIG. 9(*a*)-9(*c*), respectively.

Only spectra (c) in FIG. 10 shows a strong UV peak at 3.27 eV (379 nm). The UV emission band can be attributed to a near band-edge transition of zinc oxide, namely the recombination of free excitons through an exciton-exciton collision process. The strong UV emission in the PL spectra (c) indicates that the zinc oxide nanowires were of good crystal quality with few oxygen vacancies. Spectra (a) of FIG. 10, showed no luminescence in the visible region for the nanostructures on the $SiO_2$ substrate. The PL properties demonstrated by spectra (c) suggest that zinc oxide nanowire arrays grown from selectively anchored or deposited catalyst particles are suitable for use in optical devices.

Figure 11:
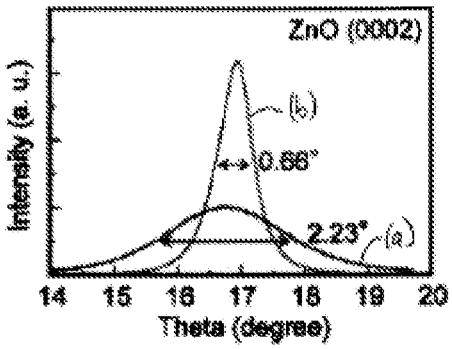
FIG. 11 contains an X-ray rocking curve of (0002) for a ZnO seed layer (a) on $SiO_2$ and (b) c-sapphire substrates. The angle 2θ was fixed at the ZnO (0002) peak observed for these samples (34.30°).
Figure 12:
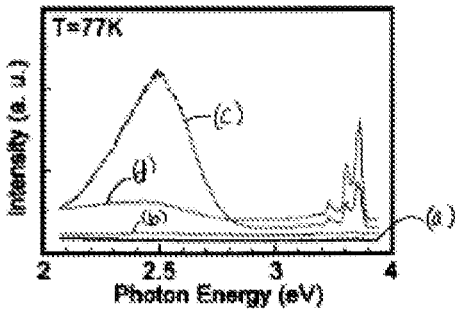
FIG. 12 contains photoluminescence spectra of VLS-grown ZnO (a) on $SiO_2$, (b) on an unmodified ZnO seed layer, (c) on a gold nanoparticle-modified ZnO seed layer on $SiO_2$, and (d) on a gold nanoparticle-modified ZnO seed layer on c-sapphire. Photoluminescence measurements were carried out using the 325 nm line of a He—Cd laser. The emission power was 6 mW. The angle between the incident laser and the substrate was 45°. The PL detector faced the substrates vertically.
Figure 13:
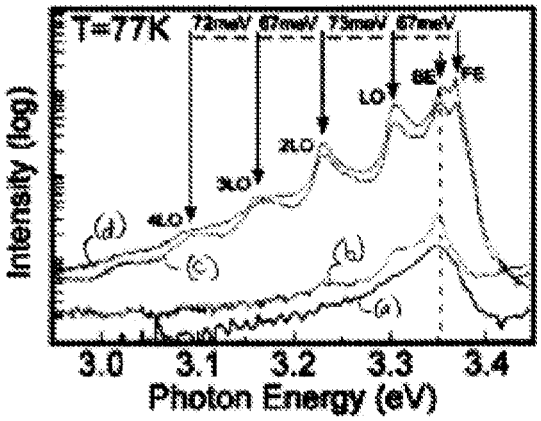
FIG. 13 contains a high-resolution photoluminescence spectra of the near-band-edge emission of VLS-grown ZnO (a) on $SiO_2$, (b) on an unmodified ZnO seed layer, (c) on a gold nanoparticle-modified ZnO seed layer on $SiO_2$, and (d) on a gold nanoparticle-modified ZnO seed layer on c-sapphire. (The intensity is on a semilogarithmic scale and "LO" refers to longitudinal optical phonon.)

FIGS. 11-13 contain additional measured data for various ZnO samples that indicate that c-sapphire substrates tend to produce ZnO nanowires with fewer dislocations and defects.

In view of the many possible embodiments to which the disclosed principles may be applied, it should be recognized that the illustrated embodiments are only examples and should not be taken as limiting the scope of the disclosure. We claim all that comes within the scope and spirit of the appended claims.

We claim:

1. A method for forming nanostructures, comprising:

providing a patterned support layer on a surface of a substrate;

contacting the patterned support layer with functionalized catalyst particles, wherein the functionalized catalyst particles selectively bond to the patterned support layer; and growing nanostructures on the patterned support layer, wherein the growth of the nanostructures is assisted by the selectively bonded functionalized catalyst particles, wherein the nanostructures include a plurality of nanowires oriented substantially vertically relative to the patterned support layer.

2. The method for claim 1, wherein providing a patterned support layer comprises forming the patterned support layer by depositing a support layer film on the substrate and removing a portion of the support layer film from the substrate.

3. The method for claim 2, wherein depositing a support layer film on the substrate comprises spin-coating the substrate with a sol-gel solution.

4. The method for claim 2, wherein the substrate comprises sapphire, $SiO_2$, silicon, or combinations thereof.

5. The method for claim 2, wherein forming the patterned support layer further comprises annealing the support layer film.

6. The method for claim 1, wherein the patterned support layer comprises a nanostructure precursor.

7. The method for claim 1, wherein the support layer comprises an oxophilic metal, hafnium-modified silicon dioxide, indium tin oxide, silicon, titanium, silicon dioxide, sapphire, an oxide, or combinations thereof.

8. The method for claim 1, wherein the support layer comprises zinc oxide.

9. The method for claim 1, wherein providing a patterned support layer comprises lithographically patterning a support layer, thereby forming the patterned support layer.

10. The method for claim 1, wherein the functionalized catalyst particles comprise functionalized metal nanoparticles.

11. The method for claim 1, wherein the functionalized catalyst particles comprise a Group VI metal, Group VII metal, gold, copper, silver or combinations thereof.

12. The method for claim 1, wherein each of the functionalized catalyst particles comprises at least one ligand having a first and a second end.

13. The method for claim 12, wherein a functionalized catalyst particle comprises a metal nanoparticle, the metal nanoparticle being coordinated by a ligand first end.

14. The method for claim 12, wherein the ligand first end comprises a sulfhydryl moiety.

15. The method for claim 12, wherein the ligand second end comprises a phosphonic acid group.

16. The method for claim 12, wherein the ligand second end comprises a 2-mercaptoethylphosphonic acid group.

17. The method for claim 1, wherein growing the nanostructures is performed using a vapor-liquid-solid method.

18. The method for claim 1, wherein the functionalized catalyst particles have an average effective diameter between about 0.5 nanometers and about 3 nanometers.

19. A nanostructure device comprising:

a plurality of nanowires in a self-assembled array, the plurality of nanowires having first ends and second ends;

a substrate in contact with the second ends of the plurality of nanowires, the plurality of nanowires oriented substantially perpendicular to a surface of the substrate;

linker molecules bonded to the first ends of the plurality of nanowires; and catalyst nanoparticles bonded to the linker molecules so as to form caps on the first ends of the nanowires, wherein the linker molecules are bonded to the catalyst nanoparticles with at least one phosphonic acid group or at least one thiol group, and to the first ends of the plurality of nanowires with at least one thiol group or at least one phosphonic acid group.

20. The nanostructure device of claim 19, wherein the catalyst nanoparticles comprise a Group VI metal, Group VII metal, gold, copper, silver or combinations thereof.

21. The nanostructure device of claim 19, wherein the plurality of nanowires comprise an oxide, nitride, or carbon.

22. The nanostructure device of claim 19, further comprising:

a first electrode in electrical contact with the second ends of the plurality of nanowires; and a second electrode located proximate to and spaced apart from the catalyst nanoparticles so as to define a gap between the catalyst nanoparticles and the second electrode.

23. The nanostructure device of claim 19, wherein the catalyst nanoparticles have an average effective diameter between about 0.5 nanometers and about 3 nanometers.

24. The nanostructure device of claim 19, wherein the linker molecules are bonded to the first ends of the plurality of nanowires with at least one phosphonic acid group and to the catalyst nanoparticles with at least one thiol group.

25. The nanostructure device of claim 19, wherein the linker molecules are bonded to the first ends of the plurality of nanowires with at least one thiol group and to the catalyst nanoparticles with at least one phosphonic acid group.

* * * * *